US006959455B2

(12) United States Patent
Hall

(10) Patent No.: US 6,959,455 B2
(45) Date of Patent: Nov. 1, 2005

(54) SUSPENDERS

(76) Inventor: David R. Hall, 3 Black Birch Dr., Amherst, NH (US) 03031

( * ) Notice: Subject to any disclaimer, the term of this patent is extended or adjusted under 35 U.S.C. 154(b) by 562 days.

(21) Appl. No.: 10/072,427

(22) Filed: Feb. 7, 2002

(65) Prior Publication Data

US 2002/0112275 A1 Aug. 22, 2002

Related U.S. Application Data

(60) Provisional application No. 60/269,451, filed on Feb. 16, 2001.

(51) Int. Cl.[7] ..... A41F 9/00
(52) U.S. Cl. ..... 2/340
(58) Field of Search ..... 2/340, 44, 45, 2/92, 310, 311, 312, 323, 326, 336, 333

(56) References Cited

U.S. PATENT DOCUMENTS

| | | | | |
|---|---|---|---|---|
| 80,112 A | | 7/1868 | Cleveland | |
| 112,746 A | | 3/1871 | Smith | |
| 179,355 A | * | 6/1876 | Schirmer et al. | 24/660 |
| 360,049 A | | 3/1887 | Raymond et al. | |
| 660,165 A | | 10/1900 | Ostrom | |
| 672,002 A | | 4/1901 | Katz | |
| 678,251 A | | 7/1901 | Hafer | |
| 1,365,056 A | | 1/1921 | Nabers | |
| 1,549,672 A | | 8/1925 | Lazier | |
| 2,668,957 A | | 2/1954 | Schmidt | |
| 2,732,561 A | | 1/1956 | Starr | |
| 3,484,870 A | | 12/1969 | Tempelhof | |
| 4,481,682 A | | 11/1984 | Hall | |
| RE33,966 E | | 6/1992 | Robison | |
| 5,168,582 A | | 12/1992 | Aldridge | |
| 5,359,731 A | | 11/1994 | Cavalier | |
| 5,497,923 A | | 3/1996 | Pearson et al. | |
| 5,564,131 A | * | 10/1996 | Anscher | 2/340 |
| 5,611,079 A | | 3/1997 | Bain, III | |
| 5,819,381 A | * | 10/1998 | Lake | 24/564 |
| 6,026,516 A | | 2/2000 | Dacyshyn | |
| 6,463,593 B2 | * | 10/2002 | Cotten | 2/227 |

FOREIGN PATENT DOCUMENTS

| | | |
|---|---|---|
| DE | 1 902 046 | 1/1969 |
| DE | 2 140 134 | 8/1971 |
| FR | 2 686 779 | 1/1992 |

OTHER PUBLICATIONS

Sidewinder™ Suspenders by BucketBoss product advertisement (1999).

* cited by examiner

*Primary Examiner*—Tejash Patel
(74) *Attorney, Agent, or Firm*—Matthew B. Loftus

(57) ABSTRACT

Apparatus having a harness including a first piece of a detachable connector. The first piece is configured to be attachable to and detachable from a second piece of the detachable connector. The harness is configured to be worn on the upper part of a body in a manner that enables it to support a garment worn on a lower part of the body.

115 Claims, 8 Drawing Sheets

SUSPENDERS

RELATED APPLICATIONS

This application claims priority to U.S. application Ser. No. 60/269,451 filed on Feb. 16, 2001, the content of which is incorporated herein by reference.

TECHNICAL FIELD

This invention relates to suspenders.

BACKGROUND

Suspenders that hold a wearer's pants at waist level typically have a pair of straps that hang over the wearer's shoulders and connect to the pants at three or four points using fasteners.

Suspenders or straps are often used with outer pants that are worn over trousers, such as ski pants, fireman's pants, waders, and rain pants. Suspenders are useful to hold up the outer pants because the overgarments extend well above the waist of the wearer, making a belt uncomfortable or even useless. Over pants are often worn under heavy jackets or coats that must be removed before the undergarment (e.g., the pants) can be taken down. When suspenders are used to suspend pants under one or more outer garments (e.g., jackets, coats, parkas, raincoats), those outer garments often are removed before the pants can be lowered or removed because the suspenders usually attach to the pants in three or four places, one or more of which is typically at the rear of the wearer and hard to reach. For a wearer to lower the pants, the wearer removes the outer garments, passes his or her arms back through the suspenders, allowing the pants and suspenders to drop. If the floor is not clean, such as in a public restroom the suspenders may be soiled if they touch the floor.

SUMMARY

In one aspect, the invention features an apparatus having a harness including a first piece of a detachable connector. The first piece is configured to be attachable to and detachable from a second piece of the detachable connector. The harness is configured to be worn on the upper part of a body in a manner that enables it to support a garment worn on a lower part of the body.

In another aspect, the invention features an apparatus having a connector including a second piece of a detachable connector. The second piece is configured to be attachable and detachable from a first piece of the detachable connector. The connector also has a clothing fixture configured to attach to an item of clothing.

In another aspect, the invention features a method. The method includes wearing a pair of pants and wearing a pair of suspenders including a harness. An upper end of a connector is removably attached to the harness and a lower end of the connector is removably attached to the pants. A layer of clothing is worn over the harness and the upper end of the connector is released from the harness without removing the layer of clothing.

In yet another aspect, the invention features apparatus having a harness. The harness includes a first piece of a first detachable connector, the first piece being configured to be attachable to and detachable from a second piece of the first detachable connector. The harness also includes a first piece of a second detachable connector, the second piece being configured to be attachable to and detachable from a second piece of the second detachable connector. The harness further includes a first strap and a second strap. Each of the first and second straps have a front end, a rear end and an intermediate portion between the front end and rear end. The front end of the first strap is adjustably connected to the first piece of the first detachable connector. The rear end of the first strap is attached to the first piece of the second detachable connector. The front end of the second strap is adjustably connected to the first piece of the second detachable connector. The rear end of the second strap is attached to the first piece of the first detachable connector. The intermediate portions of the first and second strap are slidably connected. The apparatus also has a first connector including a second piece of the first detachable connector. The second piece is configured to be attachable to and detachable from the first piece of the first detachable connector. The first connector also includes a first clothing fixture configured to attach to and detach from an item of clothing. The apparatus also has a second connector including a second piece of the second detachable connector. The second piece is configured to be attachable to and detachable from the first piece of the second detachable connector. The second connector also includes a second clothing fixture configured to attach to and detach from the item of clothing. The harness is configured to be worn on the upper part of a body in a manner that enables it to support a garment worn on a lower part of the body.

One or more of the following features may also be included. The clothing fixture is a jaw clamp, overall clip and button, strips of hook and loop tape, a button hole, or piece of fabric having a lower edge configured to be sewn to the item of clothing. The rear end of the first strap is connected to the front end of the second strap. The rear end of the second strap is connected to the front end of the first strap. The intermediate portions of the first and second straps are configured to cross behind a user. The intermediate portions of the first and second straps are slidably connected. The intermediate portions of the first and second straps are permanently connected. The apparatus has a clothing fixture disposed on the harness and configured to attach to and detach from a second item of clothing. The second item of clothing comprises a pair of outer pants. The straps comprise an elastic material. The outer pants are supported by removably connecting the outer pants to the harness at a position higher on the user than the upper end of the connector. The pair of pants or outer pants are lowered and the connector strip is reattached to the harness without removing the layer of clothing.

Embodiments of the invention may have one or more of the following advantages. A pair of pants or outer pants may be lowered without having to remove an upper garment that is worn over suspenders. The suspenders remain on the wearer and will not come in contact with the ground when the pants or outer pants are lowered. Multiple pairs of pants may be supported by one pair of suspenders. The suspenders remain on the user's shoulders whether or not they are supporting a pair of pants. The suspenders are comfortable and, when worn, do not bind up when the wearer bends forward.

Other features and advantages of the invention will be apparent from the description and from the claims.

DETAILED DESCRIPTION

In the examples below, the words "trousers" or "pants" are meant to include any lower garment worn by males or females that could be held in place with suspenders. "Outer pants" is meant to include a second lower garment worn over trousers or long underwear, such as rain pants, fireman's pants, ski pants, farmer or construction worker overalls or wet suit pants, for example.

Figure 1:
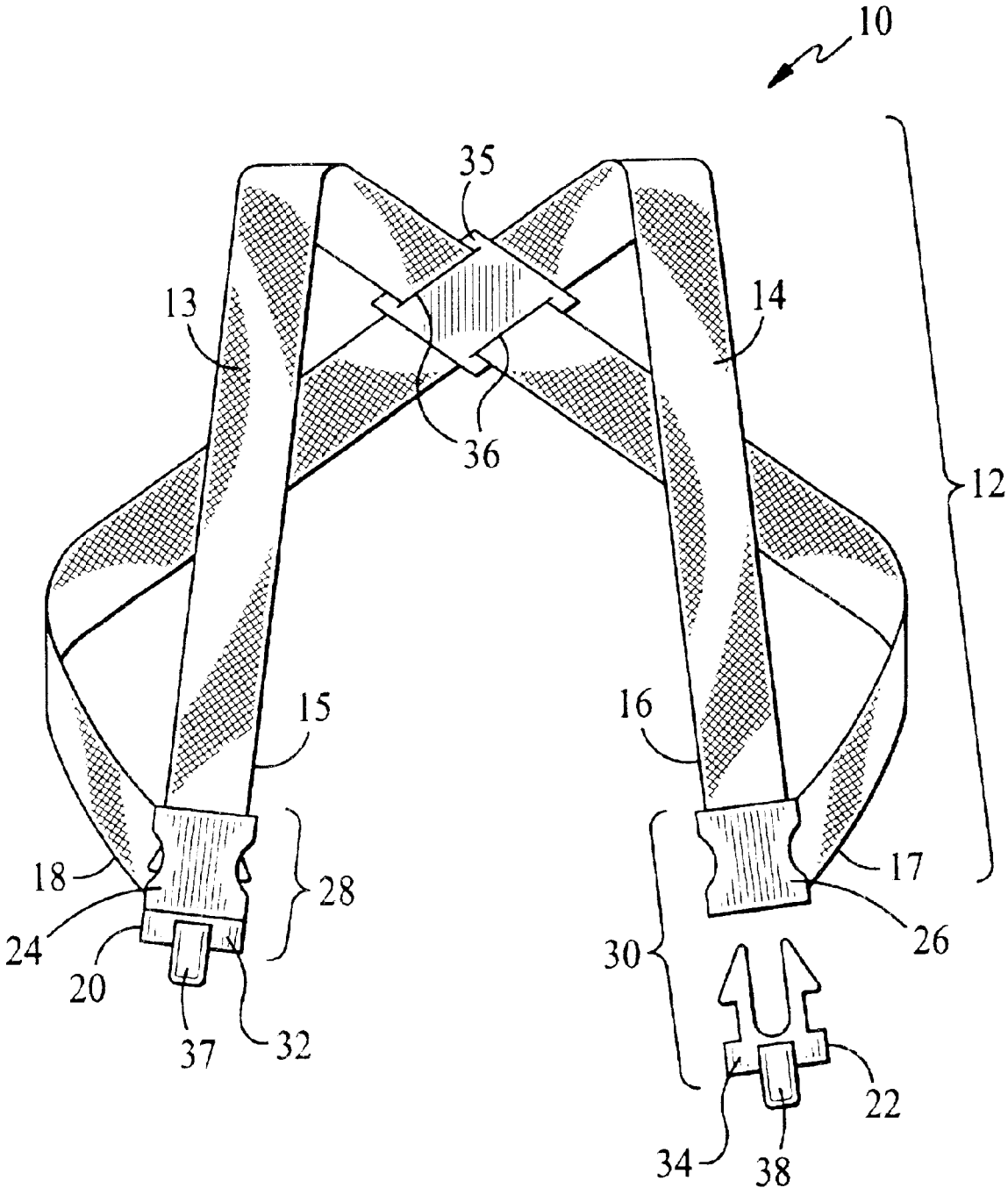
FIGS. 1, 7, 8, and 9 are front views of pairs of suspenders.

The pair of suspenders 10 shown in FIG. 1, for example, may remain on a wearer when the pants are lowered even though the wearer has one or more layers of clothing being worn over suspenders 10. Suspenders 10 include a harness 12 worn on the wearer's upper body and a pair of lower members (pants holders) 20 and 22 that connect the harness to the pants. In other examples, the harness could connect to more or less than two lower members, such as one, three, or four.

Harness 12 includes female portions 24 and 26 of quick-release buckles 28 and 30, which permit a user to quickly and easily disconnect harness 12 from mated lower (male) members 20 and 22 when he wishes to lower his pants. In other examples, other devices that permit quick and easy connection and disconnection could be substituted for buckles 28 and 30, such as jaw clamps, overall clips, or strips of hook and loop tape.

Harness 12 also includes a first strap 13 having a front end 15 and a back end 17 and a second strap 14 having a front end 16 and a back end 18. Straps 13 and 14 could be an elastic material, a non-elastic material, or some combination of both. Front end 15 of first strap 13 is attached to female portion 24 and lies near the front or side of the wearer. Front end 16 of second strap 14 is attached to female portion 26 and also lies near the front of the wearer. Straps 13 and 14 may be permanently connected to female portions 24 and 26, or they may be adjustably connected to permit adjustment of the size of the harness.

As worn, strap 13 extends up the wearer's chest and over one of his shoulders, and crosses to the wearer's back. Strap 13 continues around the wearer's torso and under the arm opposite the first shoulder, and back end 17 attaches to female portion 26. Similarly, front end 16 of strap 14 attaches to the side of female portion 26, extends up the wearer's chest and over his other shoulder, and crosses strap 13 as it crosses the wearer's back. Strap 14 continues around the wearer's torso and under the arm opposite the second shoulder, and back end 18 attaches to the side of female portion 24.

In one example, straps 13 and 14 are held together by a sliding connector 35 that prevents the straps from separating but allowing the crossover point to adjust to the wearer. Sliding connector 35 has a pair of slits 36 through which front end 15 of strap 13 passes. Front end 16 is then passed in between strap 13 and connector 35 to capture strap 14. In other examples, straps 13 and 14 could be permanently connected using stitching or could remain unattached.

Lower member 20 includes a male portion 32 of buckle 28 and a jaw clamp 37 attached to male portion 32. Lower member 22 includes a male portion 34 of buckle 30 and a jaw clamp 38 attached to male portion 34. Male portions 32 and 34 mate with female portions 24 and 26 to removably connect lower members 20 and 22 to harness 12. Jaw clamps 37 and 38 are used to removably attach lower members 20 and 22 to a pair of pants. In one example, each lower member attaches to a pair of pants at only one position on the pants. In other examples, a lower member could attach to a pair of pants at more than one position.

Figure 2:
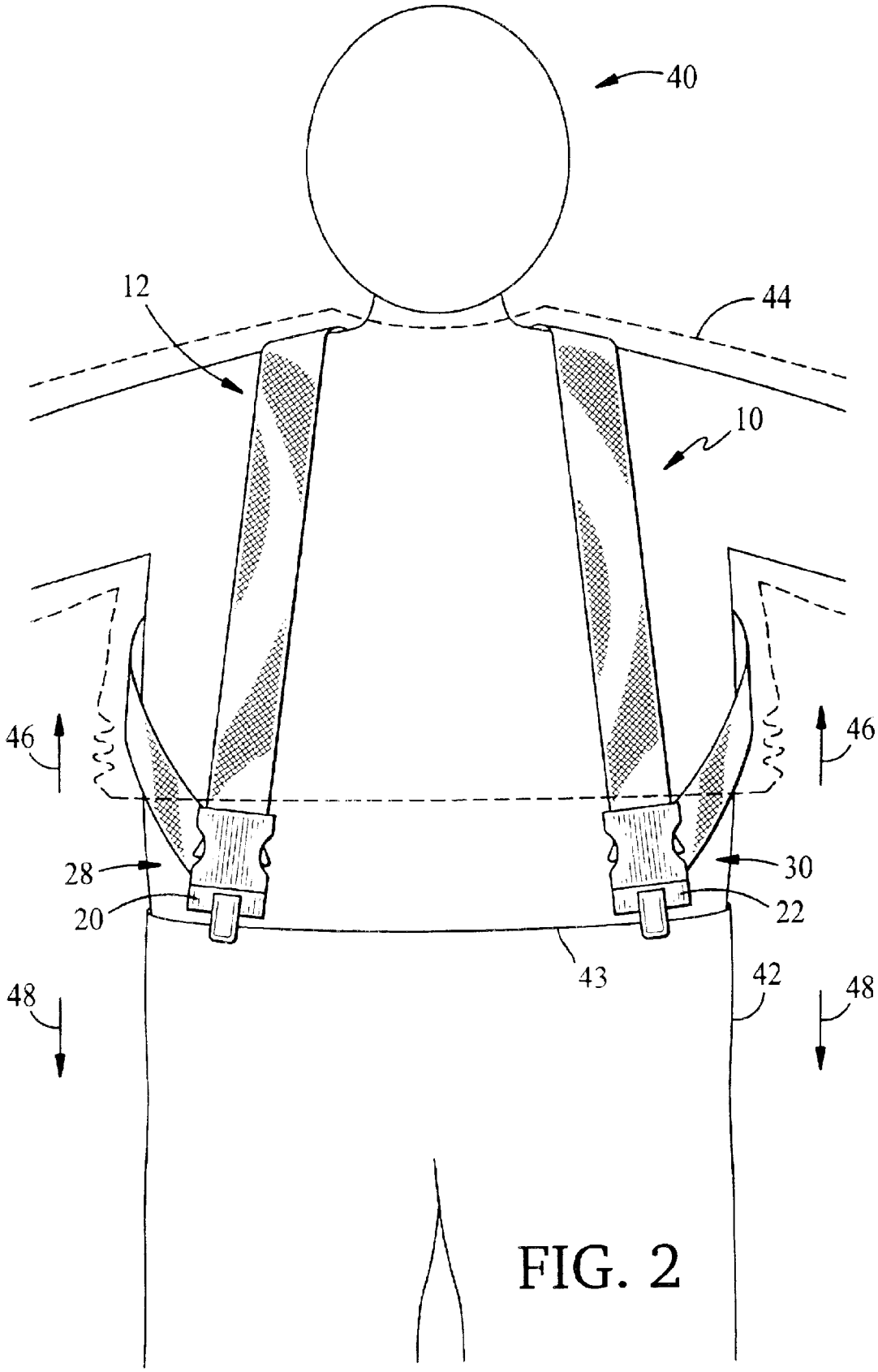
FIGS. 2, 3, and 3A are front views of a user wearing a pair of suspenders.

Referring to FIG. 2, suspenders 10 can be worn by a user 40 to support pants 42 while the user wears a garment 44 (shown in dashed line) over suspenders 10. Lower members 20 and 22 are attached to waist 43 of pants 42. In this example, user 40 may choose any number of positions on waist 43 to attach lower members 20 and 22 to pants 42. When choosing positions to which lower members 20 and 22 may be attached, a user could take into account his or her size and shape, comfort, the weight of pants 42, and weight of items to be directly or indirectly supported by suspenders 10. These items could include, for example, additional pants, other garments, items to be carried on or in pants 42, or toolbelts. The lower members 20 and 22 could also be attached to portions of the pants below the waist, for example to flaps of cloth placed on the pants for other purposes of for the purpose of providing a place to attach the lower members.

When user 40 wishes to lower pants 42 without removing garment 44, the user raises garment 44 in direction 46 to expose buckles 28 and 30. User 40 could then unbuckle harness 12 from lower members 20 and 22, leaving harness 12 in place on user 40 and allow user 40 to lower pants 42 in direction 48. When pants 42 are pulled up again to their original position and lower members 20 and 22 are re-attached to harness 12, garment 44 is returned to its original position. A unique feature of this concept is that it will work with virtually all types of pants or trousers, without modification, and with most garments worn on the upper body, such as jackets, sweaters, and sweatshirts.

In some examples, suspenders 10 could support a belt worn in a pair of pants when the belt requires additional support, such as when it carries items such as construction tools, police, or military equipment. In other examples, suspenders 10 could be used to support a belt for carrying items that is not worn in a pair of pants, such as a utility belt or a work belt.

Figure 3:
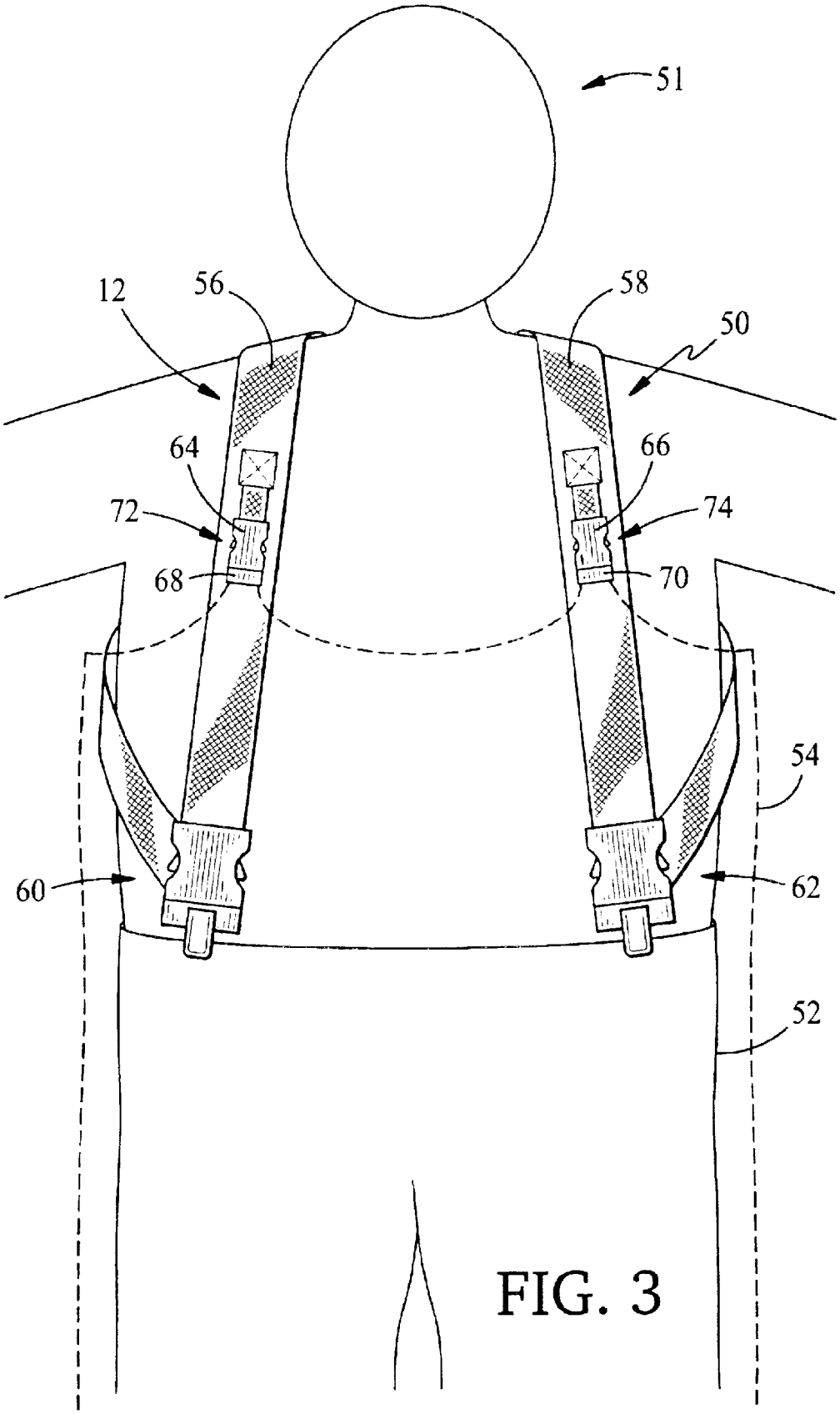

Referring to FIG. 3, one example of suspenders 50 can support a user's 51 inner pair of pants 52 and an outer pair of pants 54 (shown in dashed line) at the same time. Suspenders 50 support inner pants 52 in a similar way as suspenders 10 support pants 42 as described above. Outer pants 54 are worn over pants 52 and attach to straps 56 and 58 at positions higher on the front of the wearer's body than buckles 60 and 62. In one example, a female portion 64 of buckle 72 is attached to strap 56 and a female portion 66 of buckle 74 is attached to strap 58 so that female portions 64 and 66 lie at the front of user 51 and above buckles 60 and 62. Male portions 68 and 70 of buckles 72 and 74 are attached to outer pants 54 and positioned so that user 51 may engage buckles 72 and 74 to support outer pants 54 and release buckles 72 and 74 to lower outer pants 54. In another example, strips of hook and loop tape could be attached to the straps and rings could be attached to outer pants 54 for user 51 to support outer pants 54. In this example, the height of the outer pants may be adjusted by passing more or less of the outer pants strap through the harness rings before securing the hook and loop tape. In yet another example, one or more removable clips could be mounted on suspenders 50 to provide an adjustable attachment point for outer pants 54.

Figure 3A:
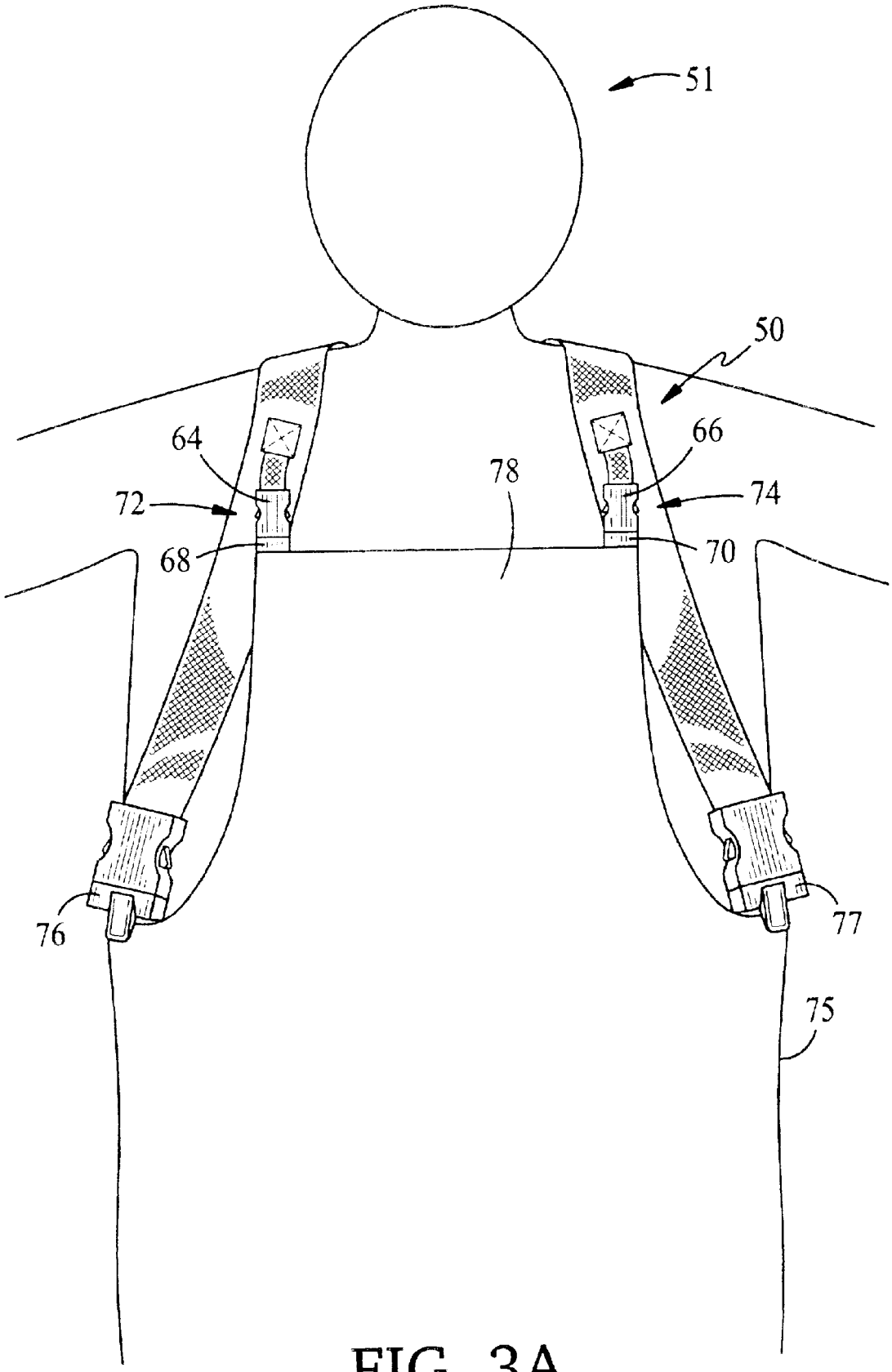

Referring to FIG. 3A, suspenders 50 could support pants 75 that extend above the waistline, such as overalls, bibs, or high waders for example. Lower members 76 and 77 attach to pants 75 near the wearer's waistline and support pants 75 as described above. Male portions 68 and 70 of buckles 72 and 74 are attached to bib 78 of pants 75 so that user 51 may further support pants 75 by engaging buckles 72 and 74.

Other implementations are within the scope of the following claims. For example, male portion 32 of buckle 28 could be mounted on harness 12 and female portion 24 of buckle 28 could be attached to lower member 20.

Figure 4:
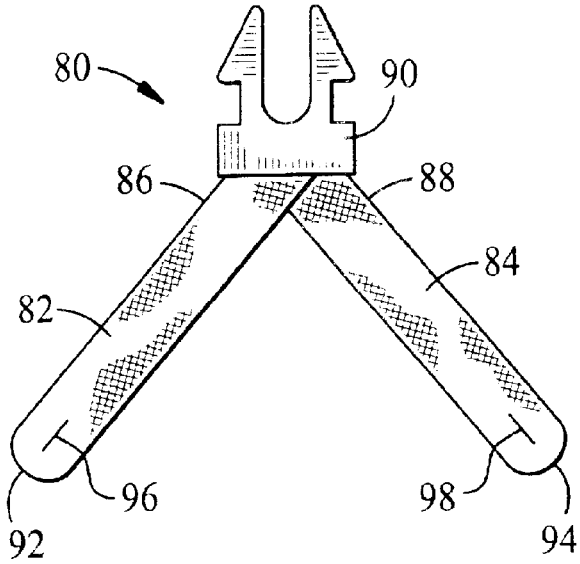
FIGS. 4, 5, and 6 are front views of connecting elements.

Referring to FIG. 4, for example, the lower member 80 could include straps 82 and 84 having upper ends 86 and 88 attached to male portion 90. Lower ends 92 and 94 of straps 82 and 84 define slit openings 96 and 98, which fit suspender buttons typically used on pants. Openings 96 and 98 could also be sized to fit rivets, studs, or other common devices for attaching suspenders to pants. Thus, suspenders 10 could attach to pants 42 at four points, as conventional suspenders do, using only two lower members 80.

Figure 5:
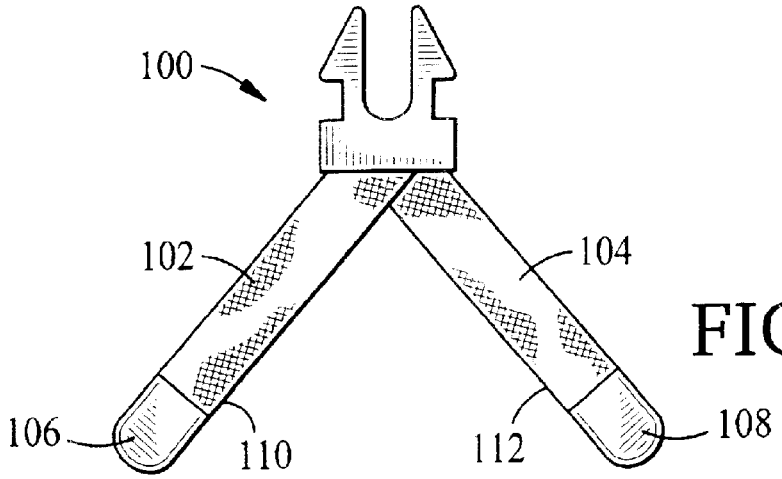

Referring to FIG. 5, lower member 100 could include straps 102 and 104 having jaw clamps 106 and 108 disposed at ends 110 and 112, combining the four point support described above with the flexibility of permitting a user to change the attachment point of lower member 100 to a pair of pants. Multiple attachment points, such as the four points described above, for example, could distribute the weight of the pants when heavy items are carried in the pants' pockets or on a belt worn in the pants.

Figure 6:
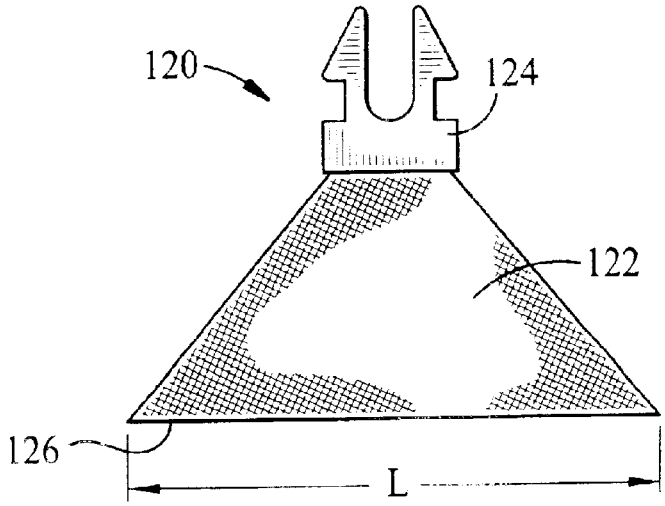

Referring to FIG. 6, lower member 120 could include a fabric 122 attached to a male portion 124 of a quick release buckle (not shown). Lower edge 126 of fabric 122 could be permanently attached to pants 42, such as by stitching, for example. Length L of lower edge 126 could be chosen to distribute the weight of the pants along length L. In one example, L is at least about 3 inches. In another example, L is at least about 4 inches. In yet another example, L is about 5 inches.

Figure 7:
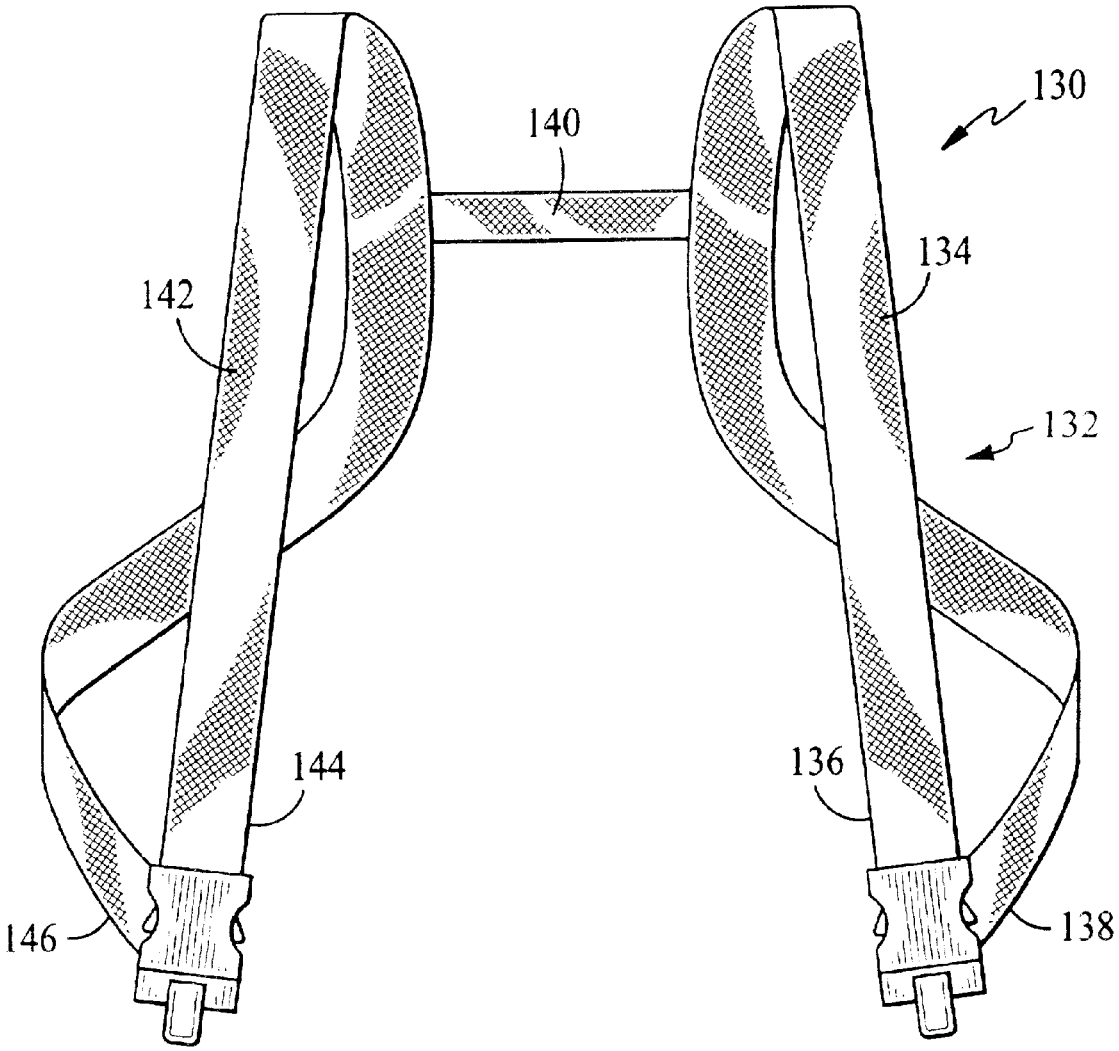

Referring to FIG. 7, suspenders 130 could include harness 132 having back end 138 of strap 134 attached to front end 136 of strap 134. Strap 134 would pass up the front of a user, over the user's shoulder on one side, down the user's back, and under the user's arm on the same side. Similarly, harness also includes strap 142 having a back end 146 attached to front end 144. Strap 140 could be connected to both straps 134 and 142 and, when worn by a user, prevent harness 132 from falling off the user's shoulders.

Figure 8:
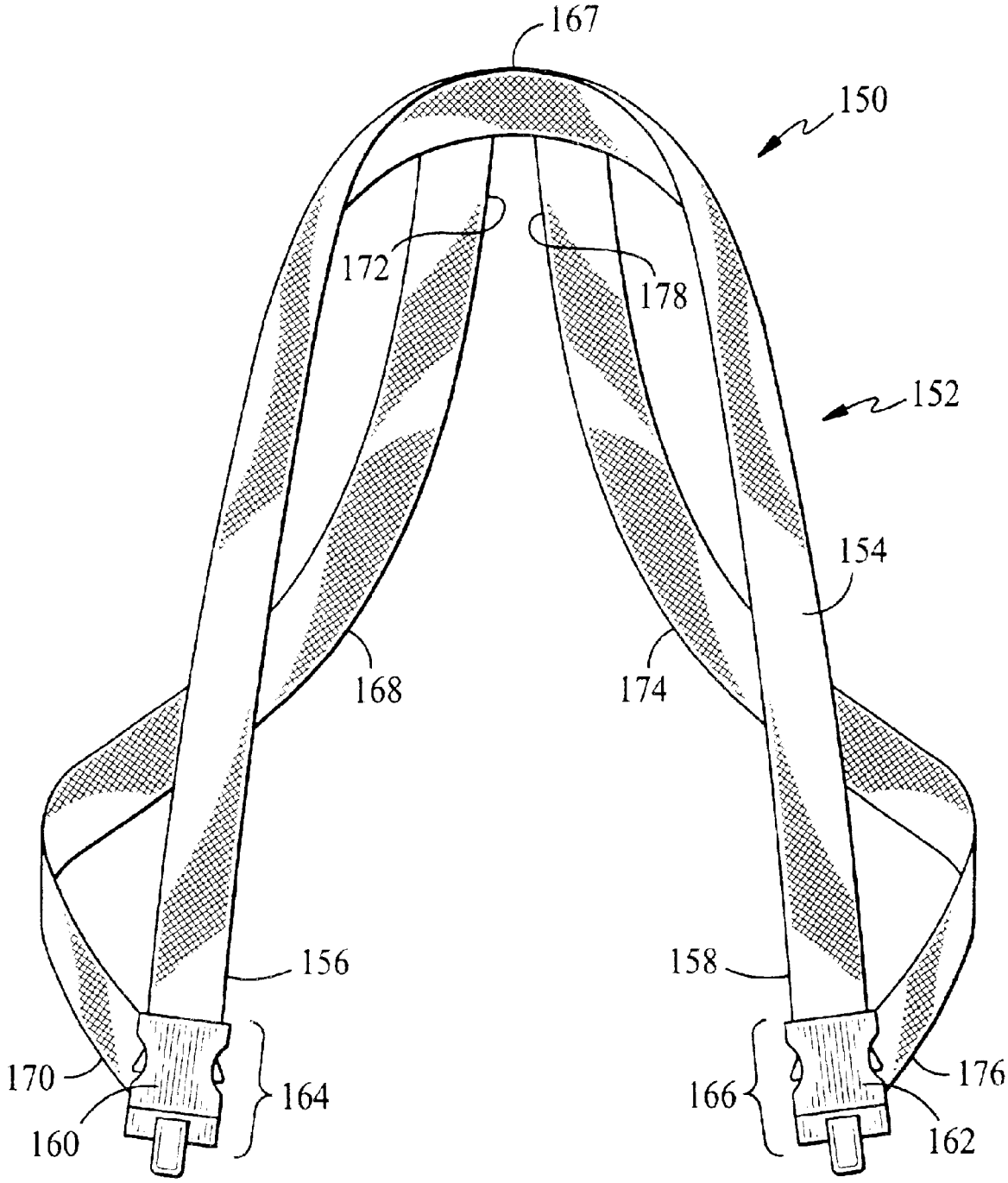

Referring to FIG. 8, suspenders 150 could include harness 152 having strap 154 with a first end 156 attached to female portion 160 of quick release buckle 164 and a second end 158 attached to a female portion 162 of quick release buckle 166. When suspenders 150 are worn by a user, intermediate portion 167 of strap 154 passes behind the user's neck. Harness 152 includes strap 168 having a front end 170 attached to first end 156 and a rear end 172 attached to intermediate portion 167. Harness 152 also includes strap 174 having a front end 176 attached to second end 158 and a rear end 178 attached to intermediate portion 167. Straps 168 and 174 pass behind a user and under the user's arm to create harness 152.

Figure 9:
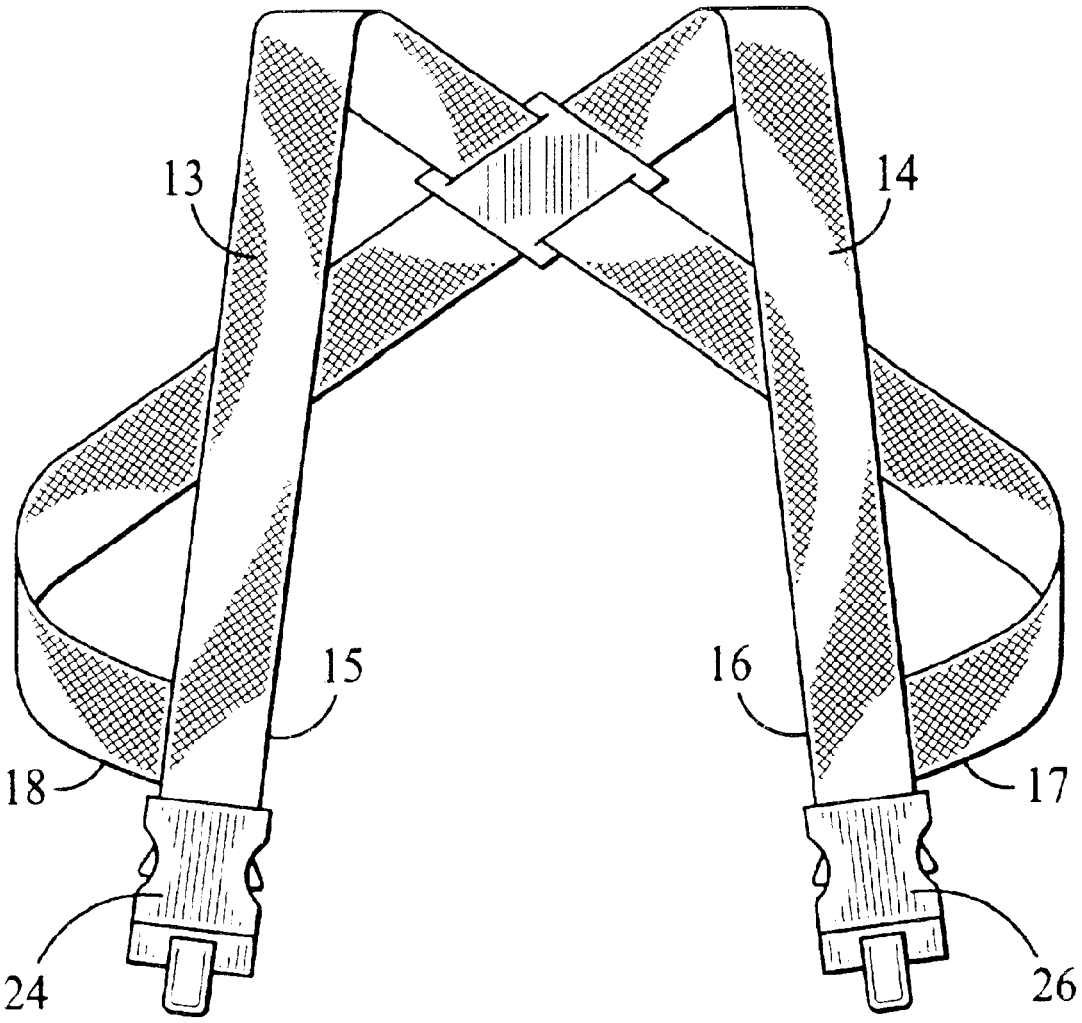

Referring to FIG. 9, back end 17 of first strap 13 could attach to front end 16 of second strap 14 above female portion 26. Similarly, back end 18 of second strap 14 could attach to front end 15 of first strap 13 above female portion 24.

In some cases, the harness could be, or be made part of, an upper garment such as a sweater or shirt.

Although the examples have discussed the use of suspenders with pants and pants, the suspenders could also be used with skirts and other kinds of garments.

What is claimed is:

1. Apparatus comprising:

a harness comprising:

a first piece of a detachable connector;

a first strap and a second strap, each of the first and second straps having a front end, a rear end, and an intermediate portion between the front and rear end, the front end of the first strap being adjustably connected to the first piece of the first detachable connector and the rear end of the second strap being generally connected to the first piece of the first detachable connector, the harness being configured to be worn on the upper part of a body in a manner that enables it to support a garment worn on a lower part of the body; and enables it to remain on a wearer whether or not it is supporting a garment; and a connector comprising a second piece of the detachable connector, the second piece being attachable to and selectively detachable from the first piece and a clothing fixture for attaching to and detaching from an item of clothing.

2. The apparatus of claim 1 wherein the harness further comprises a strap having a front end, a rear end, and an intermediate portion between the front and rear end.

3. The apparatus of claim 2 wherein the front end of the strap is adjustably connected to the first piece of the detachable connector.

4. The apparatus of claim 1 wherein the connector further comprises a clothing fixture configured to attach to and detach from an item of clothing.

5. The apparatus of claim 1 wherein the clothing fixture comprises a jaw clamp, overall clip and button, or strips of hook and loop tape.

6. The apparatus of claim 4 wherein the harness further comprises a strap having a front end, a rear end, and an intermediate portion between the front and rear end.

7. The apparatus of claim 6 wherein the front end of the strap is adjustably connected to the first piece of the detachable connector.

8. The apparatus of claim 1 wherein the harness further comprises a first piece of a second detachable connector, the front end of the second strap being adjustably connected to the first piece of the second detachable connector and the rear end of the first strap being connected to the first piece of the second detachable connector.

9. The apparatus of claim 8 further comprising:

a second connector comprising;

a second piece of the second detachable connector, the second piece being attachable to and detachable from the first piece of the second detachable connector; and a second clothing fixture configured to attach to and detach from an item of clothing.

10. The apparatus of claim 8 wherein the harness further comprises a first strap and a second strap, each of the first and second straps having a front end, a rear end and an intermediate portion between the front end and rear end.

11. The apparatus of claim 10 wherein the front end of the first strap is adjustably connected to the first piece of the first detachable connector and the front end of the second strap is adjustably connected to the first piece of the second detachable connector.

12. The apparatus of claim 11 wherein the rear end of the first strap is connected to the first piece of the second detachable connector and the rear end of the second strap is connected to the first piece of the first detachable connector.

13. The apparatus of claim 8 wherein the rear end of the first strap is joined to the front end of the second strap and the rear end of the second strap is joined to the front end of the first strap.

14. The apparatus of claim 1 wherein the intermediate portions of the first and second straps are configured to cross behind a user.

15. The apparatus of claim 1 wherein the intermediate portions of the first and second straps are slidably connected.

16. The apparatus of claim 1 wherein the intermediate portions are permanently connected.

17. The apparatus of claim 1 further comprising a clothing fixture disposed on the harness and configured to attach and detach to a second item of clothing.

18. The apparatus of claim 17 wherein the second item of clothing comprises a pair of outer pants.

19. The apparatus of claim 1 wherein the straps comprise an elastic material.

20. Apparatus comprising:

a connector comprising a second piece of a detachable connector, the piece being configured to be attachable to and detachable from a first piece of the detachable connector; and a clothing fixture configured to attach to and detach from an item of clothing.

21. The apparatus of claim 20 wherein the clothing fixture comprises a first clothing fixture and a second clothing fixture, said first and second clothing fixtures being configured to attach to and detach from an item of clothing.

22. The apparatus of claim 21 wherein the clothing fixture comprises a jaw clamp or a button hole.

23. The apparatus of claim 20 wherein the clothing fixture comprises a piece of fabric having a lower edge configured to be sewn to the item of clothing.

24. The apparatus of claim 20 further comprising a strap connecting the clothing fixture to the second piece.

25. The apparatus of claim 24 wherein the strap comprises a first strap and a second strap.

26. A method comprising:

wearing a pair of pants;

wearing a pair of suspenders comprising a harness; the harness comprising a first piece of a detachable connector;

a first strap and a second strap, each of the first and second straps having a front end, a rear end, and an intermediate portion between the front and rear end, the front end of the first strap being adjustably connected to the first piece of the first detachable connector and the rear end of the second strap being generally connected to the first piece of the first detachable connector;

removably attaching an upper end of the first piece of detachable to the harness;

a second piece of the detachable connector, the the second piece being attachable to and selectively detachable from the first piece; and removably attaching a lower end of the second piece of detachable to the pants;

wearing a layer of clothing over the harness; and releasing the upper end of the first piece of detachable connector from the harness without removing the layer of clothing the harness remaining on the wearer when the first and second piece of detachable connector is released.

27. The method of claim 26 further comprising:

wearing a pair of outer pants; and supporting the pair of outer pants by removably connecting the outer pants to the harness at a position higher on the user than the upper end of the connector.

28. The method of claim 26 further comprising lowering the pair of pants and reattaching the upper end of the connector strip to the harness without removing the layer of clothing.

29. The method of claim 26 wherein the upper end of the connector strip comprises a portion of a breakaway buckle and the harness comprises a mating portion of the breakaway buckle.

30. Apparatus comprising:

a harness comprising a first piece of a first detachable connector, the first piece being configured to be attachable to and detachable from a second piece of the first detachable connector;

a first piece of a second detachable connector, the second piece being configured to be attachable to and detachable from a second piece of the second detachable connector; and a first strap and a second strap, each of the first and second straps having a front end, a rear end and an intermediate portion between the front end and rear end, the front end of the first strap being adjustably connected to the first piece of the first detachable connector, the rear end of the first strap being attached to the first piece of the second detachable connector, the front end of the second strap being adjustably connected to the first piece of the second detachable connector, and the rear end of the second strap being attached to the first piece of the first detachable connector, the intermediate portions of the first and second strap being slidably connected;

a first connector comprising:

a second piece of the first detachable connector, the second piece being configured to be attachable to and detachable from the first piece of the first detachable connector; and a first clothing fixture configured to attach to and detach from an item of clothing; and a second connector comprising:

a second piece of the second detachable connector, the second piece being configured to be attachable to and detachable from the first piece of the second detachable connector; and a second clothing fixture configured to attach to and detach from the item of clothing; and the harness being configured to be worn on the upper part of a body in a manner that enables it to support a garment worn on a lower part of the body.

31. The apparatus of claim 1 wherein the item of clothing has an inner side and the clothing fixture is configured to attach to the inner side of the item of clothing.

32. The apparatus of claim 9 wherein the harness further comprises a first piece of a third detachable connector.

33. The apparatus of claim 32 wherein the first piece of the third detachable connector is disposed on the harness higher on a user's torso than the first detachable connector and the second detachable connector.

34. The apparatus of claim 33 wherein the first piece of the third detachable connector is configured to be disposed near the user's shoulder.

35. The apparatus of claim 32 further comprising:

a third connector comprising:

a second piece of the third detachable connector, the second piece being configured to be attachable to and detachable from the first piece of the third detachable connector; and a third clothing fixture configured to attach to and detach from the item of clothing.

36. The apparatus of claim 35 wherein the harness is configured to supports the item of clothing near the user's waist with the first part of the first detachable connector and supports the item of clothing near the user's shoulder with the first part of the third detachable connector.

37. Apparatus comprising:

a harness comprising:

a first piece of a detachable connector, the piece being configured to be attachable to and detachable from a second piece of the detachable connector, the harness being configured to be worn on the upper part of a body in a manner that enables it to support a garment worn on a lower part of the body; and a connector comprising:

a second piece of the detachable connector, the second piece being configured to be attachable to and detachable from the first piece, and a clothing fixture configured to attach to and detach from an item of clothing.

38. The apparatus of claim 37 wherein the harness further comprises a strap having a front end, a rear end, and an intermediate portion between the front and rear end.

39. The apparatus of claim 38 wherein the front end of the strap is adjustably connected to the first piece of the detachable connector.

40. The apparatus of claim 37 wherein the clothing fixture comprises a jaw clamp, overall clip and button, or strips of hook and loop tape.

41. The apparatus of claim 37 wherein the harness further comprises a strap having a front end, a rear end, and an intermediate portion between the front and rear end.

42. The apparatus of claim 41 wherein the front end of the strap is adjustably connected to the first piece of the detachable connector.

43. The apparatus of claim 37 wherein the harness further comprises a first piece of a second detachable connector.

44. The apparatus of claim 43 further comprising:

a second connector comprising;

a second piece of the second detachable connector, the second piece being configured to be attachable to and detachable from the first piece of the second detachable connector; and a second clothing fixture configured to attach to and detach from an item of clothing.

45. The apparatus of claim 43 wherein the harness further comprises a first strap and a second strap, each of the first and second straps having a front end, a rear end and an intermediate portion between the front end and rear end.

46. The apparatus of claim 45 wherein the front end of the first strap is adjustably connected to the first piece of the first detachable connector and the front end of the second strap is adjustably connected to the first piece of the second detachable connector.

47. The apparatus of claim 46 wherein the rear end of the first strap is connected to the first piece of the second detachable connector and the rear end of the second strap is connected to the first piece of the first detachable connector.

48. The apparatus of claim 46 wherein the rear end of the first strap is joined to the front end of the second strap and the rear end of the second strap is joined to the front end of the first strap.

49. The apparatus of claim 45 wherein the intermediate portions of the first and second straps are configured to cross behind a user.

50. The apparatus of claim 45 wherein the intermediate portions of the first and second straps are slidably connected.

51. The apparatus of claim 45 wherein the intermediate portions are permanently connected.

52. The apparatus of claim 43 further comprising a clothing fixture disposed on the harness and configured to attach and detach to a second item of clothing.

53. The apparatus of claim 45 wherein the second item of clothing comprises a pair of outer pants.

54. The apparatus of claim 38 wherein the strap comprise an elastic material.

55. The apparatus of claim 37 wherein the item of clothing has an inner side and the clothing fixture is configured to attach to the inner side of the item of clothing.

56. The apparatus of claim 44 wherein the harness further comprises a first piece of a third detachable connector.

57. The apparatus of claim 56 wherein the first piece of the third detachable connector is disposed on the harness higher on a user's torso than the first detachable connector and the second detachable connector.

58. The apparatus of claim 57 wherein the first piece of the third detachable connector is configured to be disposed near the user's shoulder.

59. The apparatus of claim 56 further comprising:

a third connector comprising:

a second piece of the third detachable connector, the second piece being configured to be attachable to and detachable from the first piece of the third detachable connector; and a third clothing fixture configured to attach to and detach from the item of clothing.

60. The apparatus of claim 59 wherein the harness is configured to supports the item of clothing near the users waist with the first part of the first detachable connector and supports the item of clothing near the user's shoulder with the first part of the third detachable connector.

61. Apparatus comprising:

a harness configured to be worn on the upper part of a body in a manner that enables it to support a garment worn on a lower part of the body, the harness comprising:

a first piece of a first detachable connector, the piece being configured to be attachable to and detachable from a second piece of the first detachable connector;

a first piece of a second detachable connector;

a first strap and a second strap, each of the first and second straps having a front end, a rear end and an intermediate portion between the front end and rear end wherein the front end of the first strap is adjustably connected to the first piece of the first detachable connector and the front end of the second strap is adjustably connected to the first piece of the second detachable connector.

62. The apparatus of claim 61 further comprising:

a connector comprising:

a second piece of the first detachable connector, the second piece being configured to be attachable to and detachable from the first piece of the first detachable connector; and a clothing fixture configured to attach to and detach from an item of clothing.

63. The apparatus of claim 62 wherein the clothing fixture comprises a jaw clamp, overall clip and button, or strips of book and loop tape.

64. The apparatus of claim 62 further comprising:

a second connector comprising:

a second piece of the second detachable connector, the second piece being configured to be attachable to and detachable from the first piece of the second detachable connector; and a second clothing fixture configured to attach to and detach from an item of clothing.

65. The apparatus of claim 61 wherein the rear end of the first strap is connected to the first piece of the second detachable connector and the rear end of the second strap is connected to the first piece of the first detachable connector.

66. The apparatus of claim 61 wherein the rear end of the first strap is joined to the front end of the second strap and the rear end of the second strap is joined to the front end of the first strap.

67. The apparatus of claim 61 wherein the intermediate portions of the first and second straps are configured to cross behind a user.

68. The apparatus of claim 61 wherein the intermediate portions of the first and second straps are slidably connected.

69. The apparatus of claim 61 wherein the intermediate portions are permanently connected.

70. The apparatus of claim 61 further comprising a clothing fixture disposed on the harness and configured to attach and detach to a second item of clothing.

71. The apparatus of claim 70 wherein the second item of clothing comprises a pair of outer pants.

72. The apparatus of claim 61 wherein the straps comprise an elastic material.

73. The apparatus of claim 61 wherein the item of clothing has an inner side and the clothing fixture is configured to attach to the inner side of the item of clothing.

74. The apparatus of claim 61 wherein the harness further comprises a first piece of a third detachable connector.

75. The apparatus of claim 74 wherein the first piece of the third detachable connector is disposed on the harness higher on a user's torso than the first detachable connector and the second detachable connector.

76. The apparatus of claim 75 wherein the first piece of the third detachable connector is configured to be disposed near the user's shoulder.

77. The apparatus of claim 74 further comprising:

a third connector comprising:

a second piece of the third detachable connector, the second piece being configured to be attachable to and detachable from the first piece of the third detachable connector; and a third clothing fixture configured to attach to and detach from the item of clothing.

78. The apparatus of claim 77 wherein the harness is configured to supports the item of clothing near the user's waist with the first part of the first detachable connector and supports the item of clothing near the user's shoulder with the first part of the third detachable connector.

79. Apparatus comprising:

a harness comprising a first piece of a detachable connector, the piece being configured to be attachable to and detachable from a second piece of the detachable connector, the harness being configured to be worn on the upper part of a body in a manner that enables it to support a first garment worn on a lower part of the body a clothing fixture disposed on the harness and configured to attach and detach to a second garment.

80. The apparatus of claim 79 wherein the harness further comprises a strap having a front end, a rear end, and an intermediate portion between the front and rear end.

81. The apparatus of claim 80 wherein the front end of the strap is adjustably connected to the first piece of the detachable connector.

82. The apparatus of claim 79 further comprising:

a connector comprising;

a second piece of the detachable connector, the second piece being configured to be attachable to and detachable from the first piece, and a clothing fixture configured to attach to and detach from an item of clothing.

83. The apparatus of claim 82 wherein the clothing fixture comprises a jaw clamp, overall clip and button, or strips of hook and loop tape.

84. The apparatus of claim 82 wherein the harness further comprises a strap having a front end, a rear end, and an intermediate portion between the front and rear end.

85. The apparatus of claim 84 wherein the front end of the strap is adjustably connected to the first piece of the detachable connector.

86. The apparatus of claim 79 wherein the harness further comprises a first piece of a second detachable connector.

87. The apparatus of claim 86 further comprising:

a second connector comprising;

a second piece of the second detachable connector, the second piece being configured to be attachable to and detachable from the first piece of the second detachable connector; and a second clothing fixture configured to attach to and detach from an item of clothing.

88. The apparatus of claim 86 wherein the harness further comprises a first strap and a second strap, each of the first and second straps having a front end, a rear end and an intermediate portion between the front end and rear end.

89. The apparatus of claim 88 wherein the front end of the first strap is adjustably connected to the first piece of the first detachable connector and the front end of the second strap is adjustably connected to the first piece of the second detachable connector.

90. The apparatus of claim 89 wherein the rear end of the first strap is connected to the first piece of the second detachable connector and the rear end of the second strap is connected to the first piece of the first detachable connector.

91. The apparatus of claim 89 wherein the rear end of the first strap is joined to the front end of the second strap and the rear end of the second strap is joined to the front end of the first strap.

92. The apparatus of claim 88 wherein the intermediate portions of the first and second straps are configured to cross behind a user.

93. The apparatus of claim 88 wherein the intermediate portions of the first and second straps are slidably connected.

94. The apparatus of claim 88 wherein the intermediate portions are permanently connected.

95. The apparatus of claim 79 wherein the second item of clothing comprises a pair of outer pants.

96. The apparatus of claim 88 wherein the straps comprise an elastic material.

97. The apparatus of claim 79 wherein the item of clothing has an inner side and the clothing fixture is configured to attach to the inner side of the item of clothing.

98. The apparatus of claim 87 wherein the harness further comprises a first piece of a third detachable connector.

99. The apparatus of claim 98 wherein the first piece of the third detachable connector is disposed on the harness higher on a user's torso than the first detachable connector and the second detachable connector.

100. The apparatus of claim 99 wherein the first piece of the third detachable connector is configured to be disposed near the user's shoulder.

101. The apparatus of claim 98 further comprising:

a third connector comprising:

a second piece of the third detachable connector, the second piece being configured to be attachable to and detachable from the first piece of the third detachable connector; and a third clothing fixture configured to attach to and detach from the item of clothing.

102. The apparatus of claim 101 wherein the harness is configured to supports the item of clothing near the user's waist with the first part of the first detachable connector and supports the item of clothing near the user's shoulder with the first part of the third detachable connector.

103. Apparatus comprising:

a connector comprising a second piece of a detachable connector, the piece being configured to be attachable to and detachable from a first piece of the detachable connector; and a clothing fixture configured to attach to an item of clothing wherein the clothing fixture comprises a first clothing fixture and a second clothing fixture, said first and second clothing fixtures being configured to attach to and detach from an item of clothing.

104. The apparatus of claim 103 wherein the clothing fixture comprises a jaw clamp or a button hole.

105. The apparatus of claim 103 wherein the clothing fixture comprises a piece of fabric having a lower edge configured to be sewn to the item of clothing.

106. The apparatus of claim 103 further comprising a strap connecting the clothing fixture to the second piece.

107. The apparatus of claim 106 wherein the strap comprises a first strap and a second strap.

108. A method comprising:

wearing a garment on the wearer's lower body;

wearing a pair of suspenders comprising a harness;

removably attaching an upper end of a connector to the harness while the harness remains worn;

removably attaching a lower end of the connector to the garment.

109. The method of claim 108 wherein the garment is connected to the harness near the wear&s waist.

110. The method of claim 109 wherein the garment extends up toward the wearer's torso and further comprising removably attaching the garment to the harness at a connection point near the wearer's shoulder.

111. The method of claim 110 further comprising detaching the garment from the connection point near the wearer's shoulder and rolling the garment down the torso to the wearer's waist.

112. The method of claim 108 further comprising:

wearing a pair of outer pants; and supporting the pair of outer pants by removably connecting the outer pants to the harness at a position higher on the user than the upper end of the connector.

113. The method of claim 109 further comprising wearing a layer of clothes over the harness and releasing the upper end of the connector from the harness without removing the layer of clothing.

114. The method of claim 110 further comprising lowering the pair of pants and reattaching the upper end of the connector strip to the harness without removing the layer of clothing.

115. The method of claim 108 wherein the upper end of the connector strip comprises a portion of a breakaway buckle and the harness comprises a mating portion of the breakaway buckle.

* * * * *